United States Patent [19]

Borst

[11] Patent Number: 5,038,936

[45] **Date of Patent: * Aug. 13, 1991**

[54] THERMOFORMED BLISTER CARD DISPLAY PACKAGE WITH RECLOSABLE COVER

[75] Inventor: Rodney D. Borst, Oregon, Wis.

[73] Assignee: Placon Corporation, Madison, Wis.

[ * ] Notice: The portion of the term of this patent subsequent to Jun. 5, 2007 has been disclaimed.

[21] Appl. No.: 521,348

[22] Filed: May 9, 1990

Related U.S. Application Data

[63] Continuation-in-part of Ser. No. 406,137, Sep. 11, 1989, Pat. No. 4,930,627.

[51] Int. Cl.[5] ..... B65D 43/16

[52] U.S. Cl. ..... 206/470; 53/478; 206/45.23; 206/45.34

[58] Field of Search ..... 53/449, 453, 478, 559; 156/250, 267; 206/45.23, 45.24, 45.34, 461-471, 601, 806, 807; 493/82

[56] References Cited

U.S. PATENT DOCUMENTS

| | | | |
|---|---|---|---|
| 3,034,819 | 3/1960 | Tupper . | |
| 3,111,220 | 11/1963 | Bostrom . | |
| 3,394,801 | 7/1968 | Hanson . | |
| 3,437,199 | 4/1969 | Jacobson . | |
| 3,448,853 | 6/1969 | Repko . | |
| 3,463,309 | 8/1969 | Szostek . | |
| 3,581,884 | 6/1971 | Caldwell . | |
| 3,581,885 | 6/1971 | Wald . | |
| 3,746,155 | 7/1973 | Seeley . | |
| 3,783,996 | 1/1974 | Gerard et al. . | |
| 3,967,730 | 7/1976 | Driscoll et al. . | |
| 4,005,776 | 2/1977 | Seeley . | |
| 4,106,621 | 8/1978 | Sorenson . | |
| 4,146,128 | 3/1979 | Hogg et al. . | |
| 4,155,454 | 5/1979 | Ryden . | |
| 4,200,193 | 4/1980 | Boyle . | |
| 4,236,637 | 12/1980 | Castner, Sr. et al. . | |
| 4,300,682 | 11/1981 | Kuchenbecker . | |
| 4,308,986 | 1/1982 | Parrilli . | |
| 4,319,684 | 3/1982 | Backman et al. . | |
| 4,360,106 | 11/1982 | Irvine et al. . | |
| 4,378,068 | 3/1983 | Bell . | |
| 4,384,440 | 5/1983 | Ohlsson | 53/449 |
| 4,415,084 | 11/1983 | Hauser et al. . | |
| 4,496,052 | 1/1985 | Nertman . | |
| 4,569,442 | 2/1986 | Bushey . | |
| 4,684,025 | 8/1987 | Copland et al. | 206/484 |
| 4,687,129 | 8/1987 | Cugley . | |
| 4,724,964 | 2/1988 | Hernandez . | |
| 4,739,883 | 4/1988 | Mohs et al. . | |
| 4,749,082 | 6/1988 | Gardiner et al. | 206/461 |
| 4,784,268 | 11/1988 | Perchak . | |

FOREIGN PATENT DOCUMENTS

| | | |
|---|---|---|
| 2124931 | 11/1972 | Fed. Rep. of Germany . |
| 1081502 | 8/1967 | United Kingdom . |

OTHER PUBLICATIONS

Placon drawings of cube box shaker 2/12/86.
Placon drawings of shaker 12/18/86.

*Primary Examiner*—Jimmy G. Foster
*Attorney, Agent, or Firm*—Lathrop & Clark

[57] ABSTRACT

A reclosable display package of thin flexible thermoformed material with a bubble body for sealing to a plastic backing card is disclosed. The bubble body has top, left, right, and bottom flanges, and faces defining a bubble which encloses an article compartment. An egress opening is formed in one face or in portions of several faces of the body. The reclosable display package includes a cover independent of the body and connected to the body by an integral hinge. The cover is pivotable about the integral hinge to fully close the egress opening in the body of the package. The bottom, left, and right flanges of the blister together with portions of the attached backing card may be removed to form a package with no protruding flange on three sides.

13 Claims, 8 Drawing Sheets

THERMOFORMED BLISTER CARD DISPLAY PACKAGE WITH RECLOSABLE COVER

This application is a continuation-in-part of the application Ser. No. 07/406,137 filed Sept. 11, 1989, which issued as U.S. Pat. No. 4,930,627 on June 5, 1990.

BACKGROUND OF THE INVENTION

1. Field of the Invention

This invention pertains generally to the field of packaging and containers, and particularly to reclosable display packages with blisters thermoformed from thin flexible plastic material and affixed to card stock bases.

2. Description of the Prior Art

The standard blister package consists of a clear plastic thermoformed bubble or "blister" attached to a backing card by means of an integral flange on four sides. This type of package gives a consumer a clear view of the contents of the package, is economical to produce, and is easy to load, close and ship. Blister packages are particularly well-adapted for containing a number of small articles in one package. However, the prior art blister packages, because they require that the plastic blister be sealed by means of adhesive or heat sealing on all peripheral flanges, tend to be destroyed on the first opening. Where the articles in such packages will not be entirely consumed at the first use it is usually necessary and desirable for the consumer to transfer the articles to a second container if the original container is destroyed or seriously damaged when it is opened.

Prior art blister packages that are reclosable usually require the consumer to cut, tear or deform the package in some way to access the contents. For consumer uses especially, it is desirable that the package not only be openable and reclosable, but that it be openable and reclosable without substantial damage or disfigurement to the package. A package which will be on display in a consumer's home should be attractive, clearly labeled, and provide ready identification of its contents. The prior art is replete with examples of reclosable blister packages but these generally require that the consumer cut or fold the package after purchase in some way. Packages that force the consumer to use separate implements and manually shape the reclosable package are inconvenient and, because they rely on an untrained consumer for final forming, are less consistent and reliable in their reclosable features. Furthermore, prior art packages that are easy to open often achieve this characteristic at the cost of protection to the contents of the package. It is imperative that packages for consumer products, especially those products for human consumption or bodily care, be secure against tampering prior to opening, or that the package give clear evidence of any tampering that may have taken place.

What is needed is a blister card package made from one thermoformed plastic blister that can be easily opened and reclosed without damage to the package, which can be affixed to the backing card in a tamper-resistant fashion, and which can be secured to the backing card while fully loaded.

SUMMARY OF THE INVENTION

A reclosable display package of thin flexible thermoformed plastic material according to the present invention has a bubble body for mounting on a backing card. The body has top, left, right, and bottom flanges, a front face to the body, and an egress opening in the body of the blister.

A cover is independent of the body and connected to the body by an integral hinge. The cover is pivotable about the integral hinge to fully close the egress opening in the body of the package.

It is an object of the present invention to provide a blister package with a card stock base and a reclosable cover sealed on all four sides.

It is a further object of the present invention to provide a reclosable blister package with a depending integral hinge adapted to preventing tampering with the contents of the package.

It is further an object of the present invention to provide a blister package with an egress opening that may be covered or exposed by a rotatable cover.

It is also a further object of the present invention to provide a reclosable blister package which may be displayed in a stand-up or a hanging position.

It is a still further object of the present invention to provide a reclosable blister package that may be stood upright by the consumer after the package has been opened to provide convenient access to the package contents.

It is another object of the present invention to provide a blister card display package with no protruding flanges on three sides.

These objects, and others will become apparent from the following detailed description taken in conjunction with the accompanying drawings showing a preferred embodiment of the invention for exemplification.

DESCRIPTION OF THE PREFERRED EMBODIMENT

Figure 1:
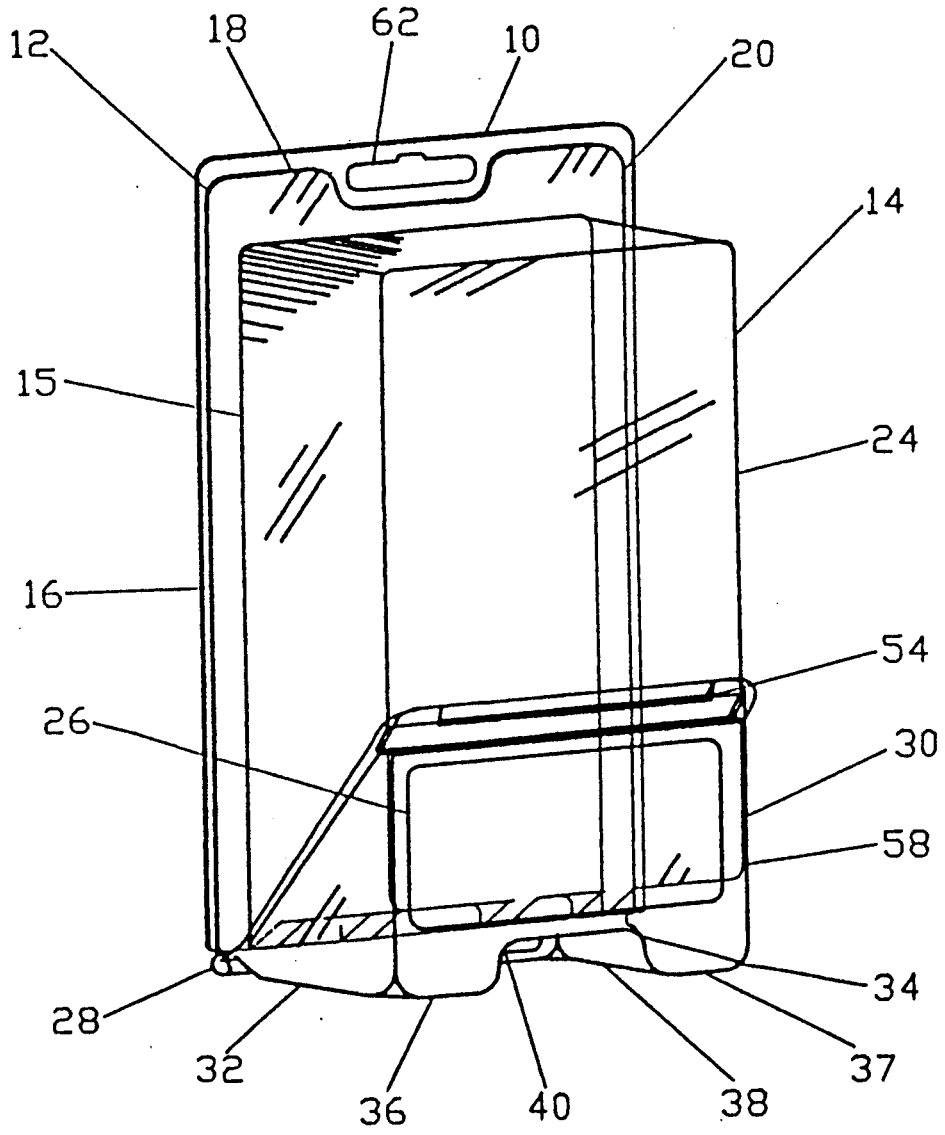
FIG. 1 is a perspective view of a blister card package of this invention, showing the package in the closed position.
Figure 2:
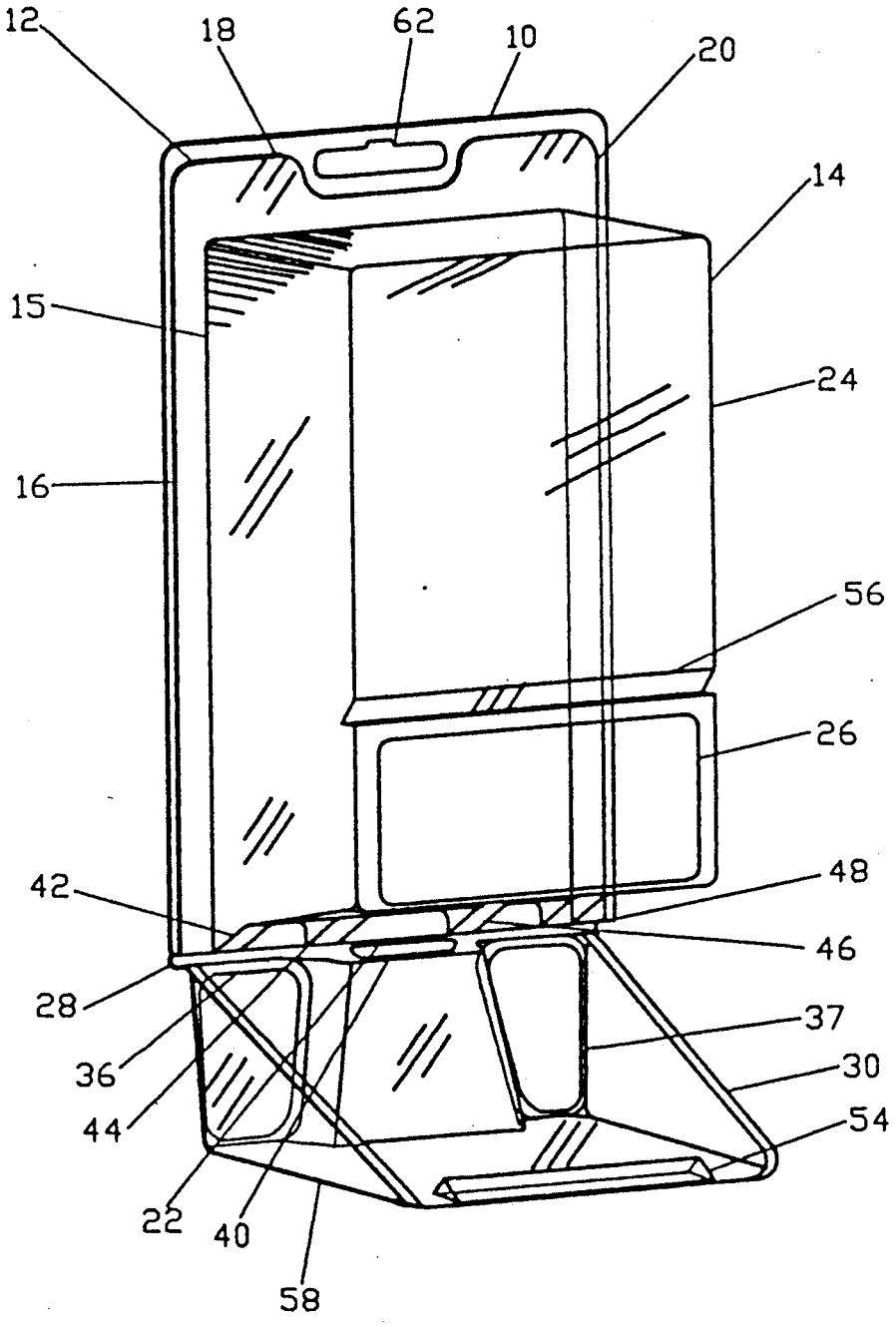
FIG. 2 is a perspective view of the package of FIG. 1, showing the package in the opened position.

Referring more particularly to FIGS. 1–9 wherein like numerals refer to similar parts, the package includes the usual backing card 10 to which is bonded the thermoformed blister 12. The blister includes a bubble body 14 having an article compartment 15, a left flange 16, a top flange 18, a right flange 20, and a bottom flange 22. The body also has a front face 24, and an egress opening 26. Depending from the bottom flange 22 and rotating about an integral hinge 28 is a rotatable cover 30. The cover preferably has two feet 32, 34 for the purpose of enabling the package to stand up straight. In FIGS. 1 and 2 can be seen the planar base portions 36, 37 of the feet. The planar base portions of the feet are in substantially the same plane as the integral hinge 28 when the cover 30 is closed as in FIGS. 1 and 3. The two feet are positioned on either side of and define an accessway 38 which provides access for a sealant tool to a sealant tool opening 40. By means of this accessway 38 the sealant tool can extend through the sealant tool opening 40 to affix the bottom flange 22 to the backing card 10 when the cover 30 is in a closed position. This feature enables the blister 12, with the cover 30 closed, to be loaded with articles prior to sealing the blister 12 to a backing card 10.

Figure 3:
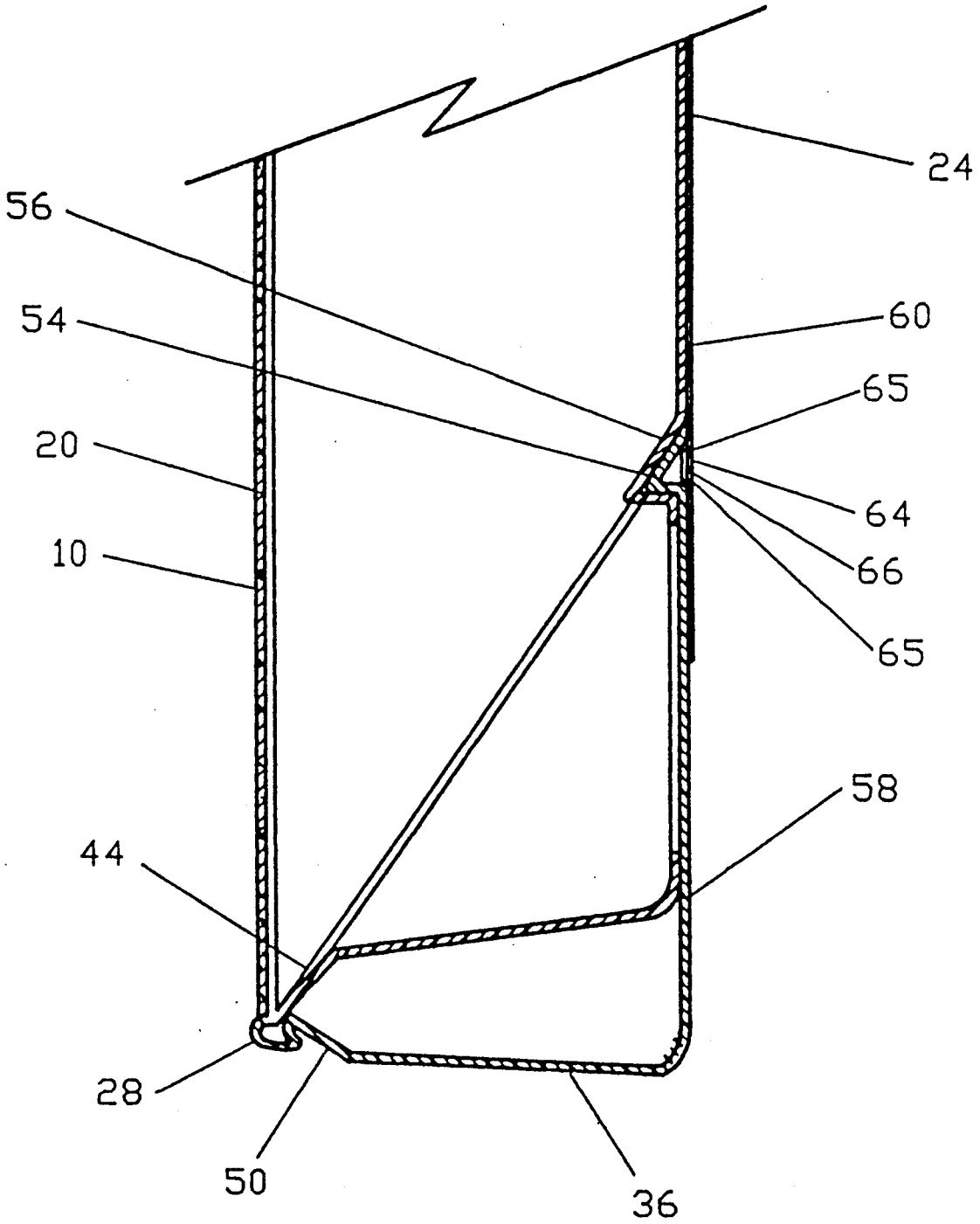
FIG. 3 is an enlarged fragmentary sectional view of the package of FIG. 1 showing the package in a closed position with a tamper-resistant label applied to the front face.

In FIG. 2 can be seen four angled gussets 42, 44, 46, 48 projecting upwardly from the bottom flange 22. These preferred gussets serve to stiffen the body bubble around the egress opening 26 and the bottom flange 22. The gussets also stiffen the bottom flange 22 and assist in retaining the bottom flange against the backing card 10 during and after sealing so as to insure a close and temper-resistant seal along the bottom of the article compartment 15. They also serve to maintain the definition of the integral hinge 28. On the opposite side of the integral hinge from the gussets, and also serving to provide definition to the integral hinge, are the angled set backs 50, 52 of the feet 32, 34 adjacent to the planar portions 36, 37. As shown in FIG. 3, these angled set backs also allow the planar portions of the feet 36, 37 to lie in substantially the same plane as the integral hinge 28 when the package is in an upright, standing position, thereby making it possible for the package to stand vertically. The location and structure of the angled set backs 50, 52 adjacent to the integral hinge 28 particularly serve to stiffen the blister around the integral hinge and prevent excessive distortion of the integral hinge, enabling it to stiffly resist attempts at tampering with the bottom flange 22.

The integral hinge 28 depends from the bottom flange 22 and has a roughly C-shaped cross section providing that when the cover 30 is closed over the egress opening 26 and the bottom flange 22 is affixed to the backing card 10 the length of the integral hinge 28 will extend backwards slightly beyond the plane of the backing card 10. As shown in FIG. 3, the integral hinge 28 thus blocks access to the interior of the body bubble between unsealed portions of the bottom flange 22 and backing card 10, giving added protection against tampering with or contamination of the package contents.

The cover 30 may be repeatedly rotated about the integral hinge 28 to cover or reveal the egress opening 26. The cover is held in the closed position by means of a projecting wedge 54 extending from the cover and a wedge-shaped depression 56 located in the front face 24 above the egress opening 26. The wedge-shaped depression 56 is suited to hold and retain the projecting wedge 54 in snap-fit relation.

To fill the package with articles the cover 30 is first closed over the egress opening 26. As seen in FIG. 3 the front face 58 of the cover and the front face 24 of the bubble body are then in substantially the same plane and adapted to receive a continuous adhesive-backed label 60 either before or after the package is filled. This label serves to seal the package. With the cover in the closed position, the package is filled with articles, the backing card 10 is placed along the thermoformed blister, and the left flange 16, top flange 18, and right flange 20 are affixed to the backing card by heat sealing. The bottom flange 22 is reached by a sealant tool through the sealant tool opening 40 in the cover 30 and also affixed to the backing card 10.

The retailer may now display the package either in a hanging fashion by inserting a hook through display slot 62, or on a shelf in an upright standing position by standing the package on the base composed of the feet 32, 34 and the integral hinge 28. The normally smooth, uninterrupted face of the adhesive label of a displayed package will then readily indicate any tampering with or pilferage of the contents of the package. This resistance to clandestine tampering makes the package particularly suited for health care or cosmetic articles, such as cotton swabs.

The adhesive label 60 for the package may contain an integral tear tab 64 with perforated lines 65 separating the tab from the portions of the label affixed to the front face 24 of the body 14 and the front face 58 of the cover 30. This tear tab 64 overlies the joint formed by the projecting wedge 54 and the wedge-shaped depression 56, and is not affixed to the blister at all due to its backing by a paper backing 66 which also serves to stiffen the tear tab. When the consumer wishes to open the package he simply grasps the extending portion of the tear tab 64 and pulls it across the face of the blister 12, separating the tab 64 from the two remaining portions of the adhesive label 60 along the perforated lines 65. Once the tear tab 64 has been removed the cover 30 may be freely disengaged and rotated.

Alternatively, an adhesive label without a tear tab may be employed. To open the package, the consumer can slit the adhesive label 60 with a sharp object such as a knife, nail file, or fingernail along the joint formed by the projecting wedge 54 and the wedge-shaped depression 56 which acts as a template for breaking any adhesive label applied over the joint. Or, if desired, the label can be perforated along an intended cutline to facilitate use of fingernails to open.

Figure 4:
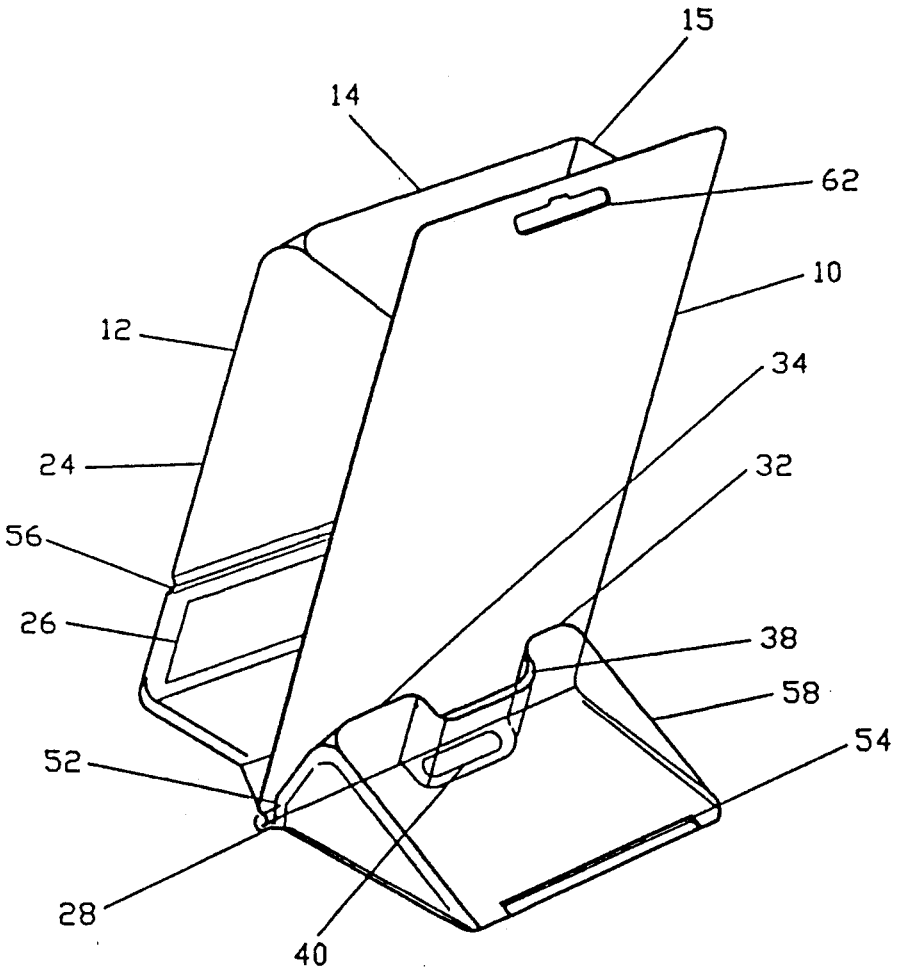
FIG. 4 is a rear perspective view of the package of FIG. 1 shown in an opened, upright, inclined position.
Figure 5:
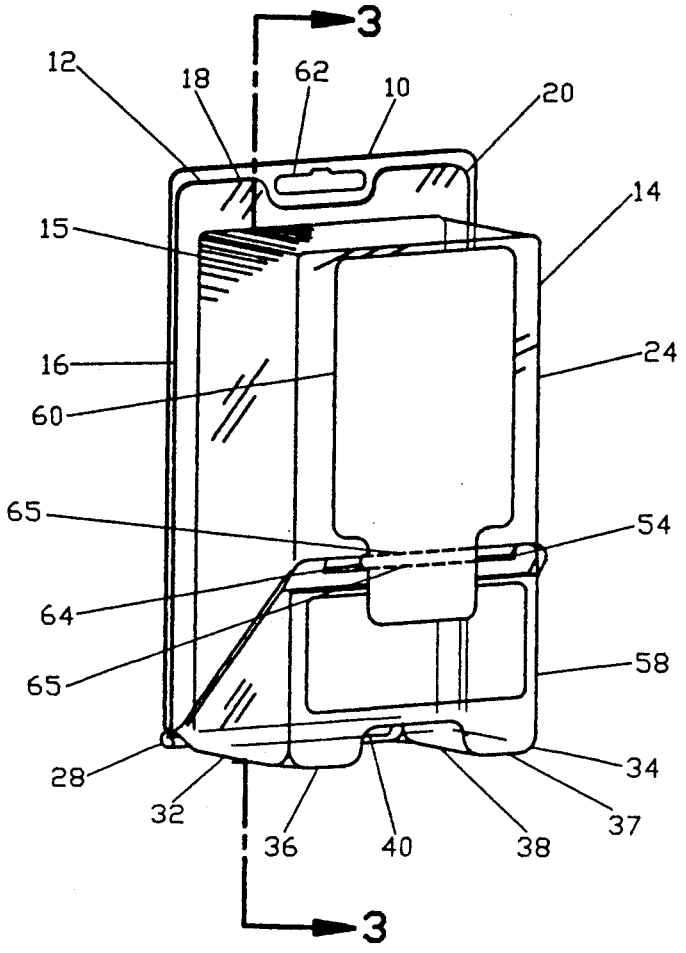
FIG. 5 is a perspective view of the blister card package of FIG. 1 with a tamper-resistant label.

When the consumer folds down the cover 30 there is ready access to the articles contained within the package through the egress opening 26. If the consumer desires, he may fold the cover backwards around the integral hinge 28 until the planar portions of the feet 36, 37 meet the back of the backing card 10. The cover then serves to support the opened package in a backwardly inclined upright position as shown in FIG. 4 for ready inspection of and access to the package contents by consumers.

Figure 6:
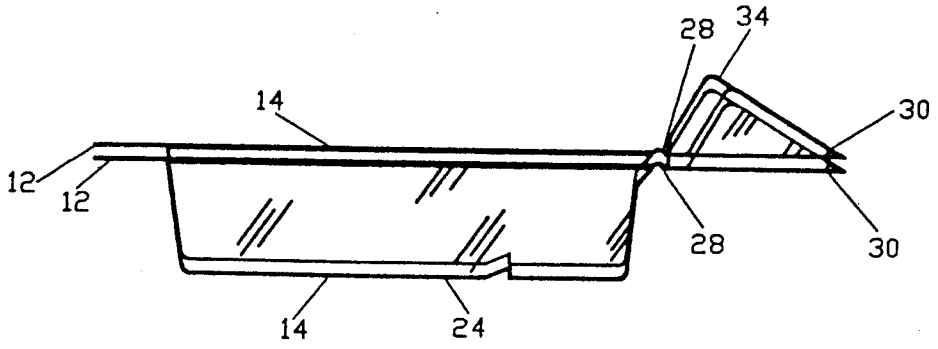
FIG. 6 is a side view of two of the blisters of the invention showing how the blisters may be compactly nested and stacked.

Prior to affixing the backing cards, the thermoformed blisters 12 may be stacked in nested relation as shown in FIG. 6 to provide for compact shipping and storage.

Figure 7:
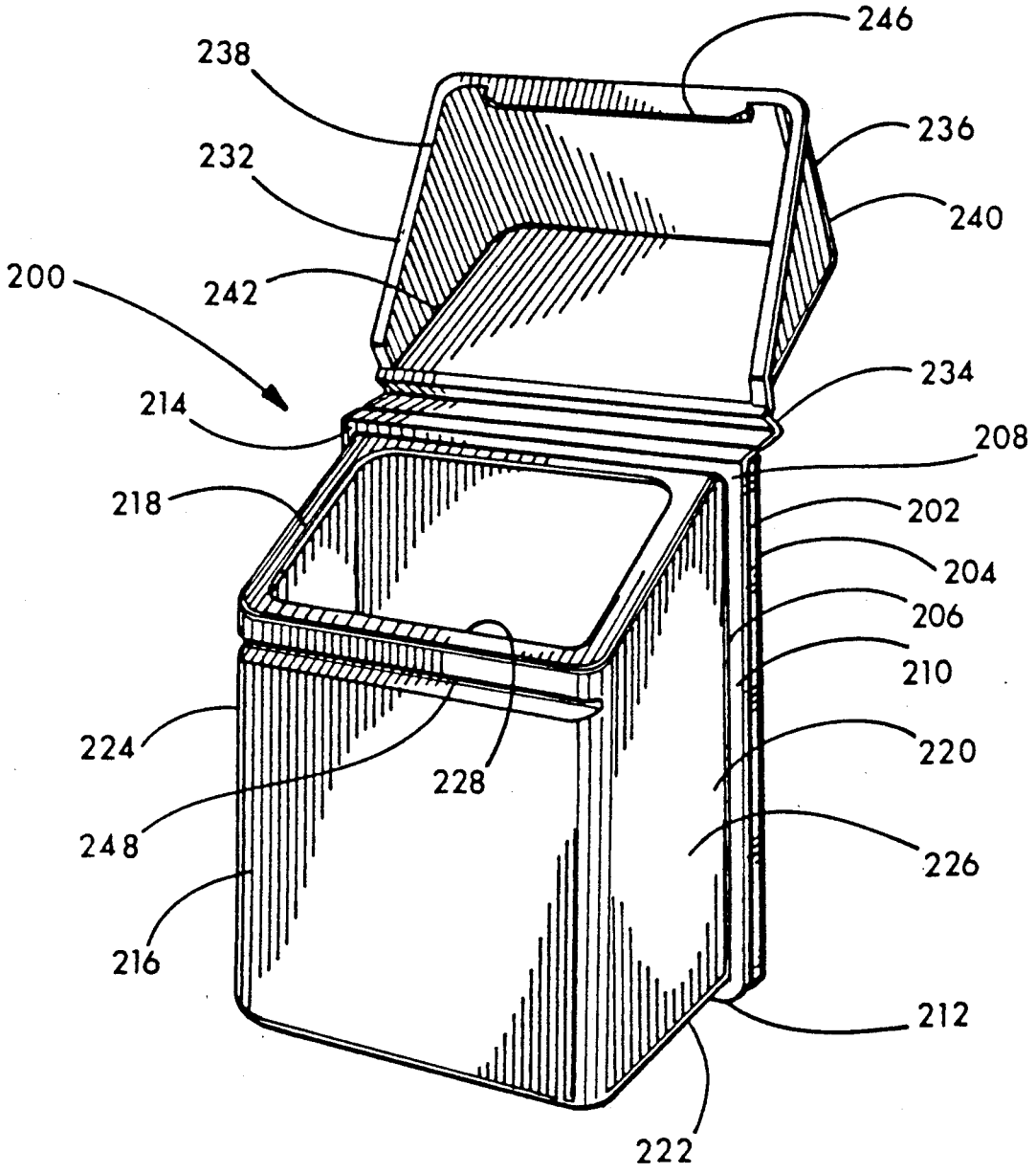
FIG. 7 is a perspective view of an alternative embodiment of the package of this container having a top opening in an inclined front face and shown in an open position.
Figure 8:
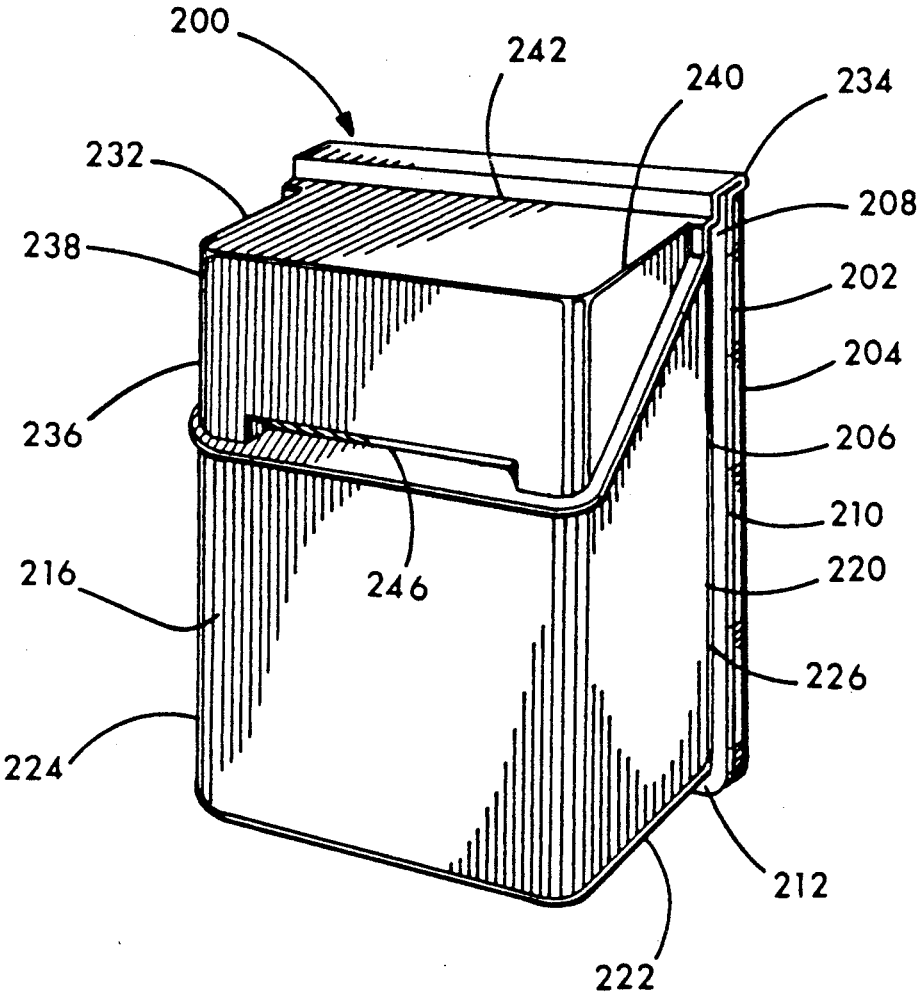
FIG. 8 is a perspective view of the package of FIG. 7 shown in a closed position.
Figure 9:
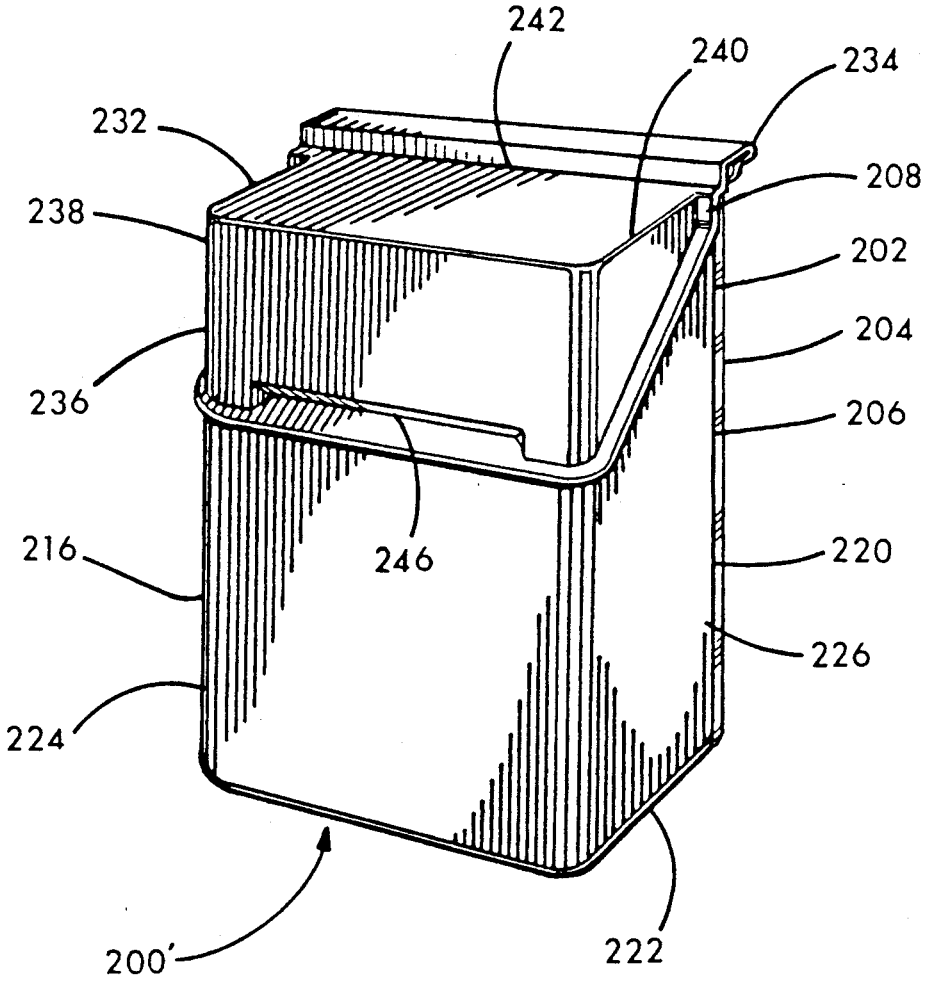
FIG. 9 is a perspective view of the closed package of FIG. 8 in which the side and bottom flanges have been removed.

A further alternative embodiment of the package of this invention is shown in FIGS. 7–9. The package 200 is adapted for permitting access to the contents through a top-opening cover. The package 200 has a thin thermoformed thermoplastic blister 202 attached to a backing card 204. In the package 200 the backing card is preferably a plastic card formed of the same plastic as the blister 202. The blister 202 has a bubble body 206 with a top flange 208, a right flange 210, a bottom flange 212, and a left flange 214. The flanges may be heat sealed to the backing card 204, but are preferably sealed by a radio frequency sealing method or by ultrasonic sealing. The bubble body 206 has a frontwardly facing face which is composed of two segments, one substantially parallel to the backing card and another inclined towards the backing card. For convenience in distinguishing the two portions of the frontwardly facing segments, the segment parallel to the card will be designated the front face 216 and the inclined segment will be designated the top face 218. The bubble body 206 also has a right side face 220, a bottom face 222, and a left side face 224. The front, top, right side, bottom, and left side faces 216, 218, 220, 222, 224 define an article compartment 226 for containing the contents of the package 200. The front face 216 connects the bottom face 222 to the top face 218. The inclined top face 218 is joined to the top flange 208.

The top face 218 has portions defining an egress opening 228 through which a user may remove the contents of the package 200. The cover 232 is connected to the top flange 208 by an integral hinge 234. The integral hinge is generally C-shaped in cross section so that portions of the hinge extend beyond the plane of the top flange 208 of the bubble body 206 to block access to the interior of the body beneath the top flange 208. The cover 232 is independent of the bubble body 206 and is adapted to rotate about the integral hinge 234 to close upon the bubble body 206 and cover the egress opening 228 in the top face 218 as shown in FIG. 8. The cover 232 has a front face 236, a left side face 238, a right side face 240 and a top face 242. The cover front face 236 has a projecting wedge 146 formed thereon which is adapted to engage in a wedge-shaped depression 248 on the front face 216 of the bubble body 206.

Since the top face 218 is inclined towards the front face 216 the contents of the article compartment 226 may extend somewhat beyond the article compartment so that the extending articles may be easily grasped by a user. When the cover is closed upon the bubble body 206, the cover 232 may enclose and surround those portions of the articles which extend beyond the article compartment 226. Alternatively, the front face may be perpendicular to the backing card 204 if desired.

The right, bottom, and left flanges 210, 212, 214 of the package 200 may be removed by a trimming or grinding process to form the package 200' as shown in FIG. 9. Removal of the top and side flanges produces a package which has a smooth appearance and which may be stood upright on the bottom face 222 of the bubble body 206.

Packages embodying this invention need not contain all the features of the preferred embodiment. Packages of this invention may be formed with more than two feet on the cover, or with no feet at all. The sealant tool opening may be larger or smaller than illustrated or may be absent altogether if the blister is to be sealed to the card with the cover open. There may be two or more sealant tool openings. The cover may be attached at the top or the sides of the package. Or, there may be more than one cover on a package, with a proportionate increase in number of integral hinges and sealant tool openings. The blister bubble may be of a non-rectangular plan, or may be particularly shaped to suit any contents. There may be more than one blister on a card. Instead of affixing a paper label to the blister face, the plastic of the blister may be imprinted.

The egress opening may be in the top, bottom or side faces of the body bubble, or in a combination of faces. The cover may be of any appropriate dimensions to effectively cover the egress opening. The face or faces in which the egress opening is formed may be formed as a planar, a multi-planar, or a curved surface.

It should be understood that this invention is not limited to the particular construction and arrangement of parts herein illustrated and described, but embodies all such modified forms as come within the scope of the following claims.

I claim:

1. A thermoformed blister of flexible plastic material for a reclosable blister card display package comprising:

(a) a bubble body, the body having a bottom face, front face, side faces, and a top face defining an article compartment, and top, left, right and bottom peripheral flanges, for sealing to a backing card to close the article compartment, wherein the front face connects the bottom face to the top face, and the top face is connected to the top flange and has portions defining an egress opening;

(b) a cover independent of the body and connected to the top flange of the body by an integral hinge, the cover being pivotable about the integral hinge between a first position in which the cover fully closes the egress opening in the top face and a second position in which the egress opening is fully revealed for unimpeded access thereto; and (c) means formed in the body front face and the cover for releaseably fastening the cover to the front face in the cover first position.

2. The reclosable package blister of claim 1 wherein the integral hinged is of a closed C-type structure and wherein portions of the hinge extend beyond the plane of the connected flange to block access to the interior of the body beneath the connected flange.

3. The blister of claim 1 wherein the top face is inclined from the top flange to the front face so that the egress opening faces frontwardly.

4. The thermoformed plastic blister of claim 1 wherein the blister is affixed to a paperboard backing card at the top, left and right and bottom peripheral flanges.

5. A thermoformed blister card display package comprising:

(a) a plastic backing card;

(b) a thermoformed plastic blister having a bubble body with top, left, right and bottom peripheral flanges which are sealed to the plastic backing card, top, left, right, and bottom side faces connected to the top, left, right, and bottom flanges respectively, and a front face adjoining the top, left, right, and bottom faces and the side faces and the front face together with the backing card define an article compartment, wherein the top face has portions defining an egress opening;

(c) a cover independent of the body and connected to the top flange of the body by an integral hinge, the cover being pivotable about the integral hinge between a first position in which the cover fully closes the egress opening in the top face and a second position in which the egress opening is fully revealed for unimpeded access thereto; and (d) means formed in the body and the cover for releasably fastening the cover to the body in the cover first position.

6. The package of claim 5 wherein the blister and the backing card are formed of the same plastic material.

7. The package of claim 5 wherein the top face is inclined towards the front face so the egress opening faces frontwardly.

8. The package of claim 5 wherein the backing card is ultrasonically sealed to the thermoformed blister.

9. The process of claim 8 wherein the blister is sealed to the backing card by radio frequency sealing.

10. The process of claim 8 wherein the blister is sealed to the backing card by ultrasonic sealing.

11. The package of claim 5 wherein the backing card is radio frequency sealed to the thermoformed blister.

12. The package of claim 5 wherein the left, right, and bottom flanges are substantially flush with the left, right, and bottom side faces of the blister.

13. A process for forming a blister card display package comprising the following steps:

(a) sealing the top, left, right, and bottom peripheral flanges of the blister of claim 1 to a plastic backing card; and (b) trimming the portions of the sealed card and left, right, and bottom peripheral flanges which protrude outwardly adjacent the left, right, and bottom faces of the package.

* * * * *